US009845605B2

(12) United States Patent
Cao et al.

(10) Patent No.: US 9,845,605 B2
(45) Date of Patent: Dec. 19, 2017

(54) SYSTEM AND METHOD FOR AUTOMATICALLY REGULATING TENSIONS OF GUIDE ROPES OF FLEXIBLE CABLE SUSPENSION PLATFORM

(71) Applicant: China University of Mining and Technology, Xuzhou, Jiangsu (CN)

(72) Inventors: Guohua Cao, Jiangsu (CN); Yandong Wang, Jiangsu (CN); Zhencai Zhu, Jiangsu (CN); Weihong Peng, Jiangsu (CN); Jinjie Wang, Jiangsu (CN); Zhi Liu, Jiangsu (CN); Shanzeng Liu, Jiangsu (CN); Gang Shen, Jiangsu (CN); Jishan Xia, Jiangsu (CN); Lei Zhang, Jiangsu (CN)

(73) Assignee: Science Academy of China University of Mining and Technology, Xuzhou (CN)

( * ) Notice: Subject to any disclaimer, the term of this patent is extended or adjusted under 35 U.S.C. 154(b) by 156 days.

(21) Appl. No.: 14/408,767

(22) PCT Filed: Jan. 27, 2014

(86) PCT No.: PCT/CN2014/071574
§ 371 (c)(1),
(2) Date: Dec. 17, 2014

(87) PCT Pub. No.: WO2015/003489
PCT Pub. Date: Jan. 15, 2015

(65) Prior Publication Data

US 2016/0251863 A1 Sep. 1, 2016

(30) Foreign Application Priority Data

Jul. 8, 2013 (CN) ..... 2013 1 0285331

(51) Int. Cl.
*E04G 3/30* (2006.01)
*E04G 3/32* (2006.01)
(Continued)

(52) U.S. Cl.
CPC ..... *E04G 3/325* (2013.01); *B66C 13/04* (2013.01); *E04G 2003/286* (2013.01)

(58) Field of Classification Search
CPC .. E04G 3/325; E04G 3/32; E04G 3/30; E04G 3/305; B66C 13/04
See application file for complete search history.

(56) References Cited

U.S. PATENT DOCUMENTS 3,586,127 A * 6/1971 Jones ..... E04G 3/32 182/133
3,866,382 A * 2/1975 Van Tassel ..... B66F 11/04 182/128
(Continued)

FOREIGN PATENT DOCUMENTS

CN 1178189 A 4/1998
CN 2331637 Y 8/1999
(Continued)

OTHER PUBLICATIONS

Anle Sang, "Talking of Improvements of Steel Cable Balancing Method of Multiple Ropes Lifts", Journal of Huainan Vocational and Technical College, No. 2, vol. 7, Dec. 31, 2007, 3 pages.
(Continued)

*Primary Examiner* — Daniel Cahn
(74) *Attorney, Agent, or Firm* — Patterson Thuente Pedersen, P.A.

(57) ABSTRACT

A system and a method for automatically regulating the tensions of the guide ropes of a flexible cable suspension platform. The system includes a guide rope regulator mounted on a flexible cable suspension platform, a hydraulic
(Continued)

pump station arranged on the flexible cable suspension platform, and a hydraulic system associated to the hydraulic pump station. The guide rope regulator automatically regulates the tensions of the guide ropes to enable the tensions of all the guide ropes to be consistent, so as to further ensure that the flexible cable suspension platform is in a level condition. The guide rope regulator also can measure the tension states of the guide ropes conveniently so as to ensure that the guide ropes have enough tensions to efficiently limit the swing amplitude of a lilting container. The system is simple, and convenient to operate, and has a good automatic regulating effect.

4 Claims, 4 Drawing Sheets

(51) Int. Cl.
*B66C 13/04* (2006.01)
*E04G 3/28* (2006.01)

(56) References Cited

U.S. PATENT DOCUMENTS 3,866,718 A * 2/1975 Hiergeist ..... B66B 7/10 187/262
4,058,184 A * 11/1977 Stuart ..... E04G 1/36 182/128
4,068,895 A * 1/1978 Reese ..... C21B 7/06 173/195
4,120,378 A * 10/1978 Mills ..... E04G 3/24 182/128
4,276,956 A * 7/1981 Mamula ..... C21B 9/06 182/128
4,732,235 A * 3/1988 Reed ..... E04G 3/30 182/142
4,981,196 A * 1/1991 Palm ..... E04G 3/30 182/112
5,007,501 A * 4/1991 Baston ..... E04G 1/152 182/128
5,083,895 A * 1/1992 McBirnie ..... B66C 1/447 414/728
2005/0217936 A1* 10/2005 Jolicoeur ..... E01D 19/106 182/130
2006/0086568 A1* 4/2006 Vaillancourt ..... E01D 19/106 182/36
2008/0053750 A1* 3/2008 Tseng ..... A62B 1/02 182/82
2013/0118839 A1* 5/2013 Penn ..... B66B 11/06 187/262
2014/0202087 A1* 7/2014 Jolicoeur ..... E04G 3/30 52/27
2017/0038204 A1* 2/2017 Kilpelainen ..... G01C 3/08
2017/0204886 A1* 7/2017 Wang ..... F15B 21/008

FOREIGN PATENT DOCUMENTS

CN 202499676 U 10/2012
CN 103359645 A 10/2013
JP 07206319 A 8/1995
WO WO 2015/003489 A1 1/2015

OTHER PUBLICATIONS

PCT International Search Report for International Application No. PCT/CN2014/071574, dated Apr. 18, 2014, 3 pages.

* cited by examiner

SYSTEM AND METHOD FOR AUTOMATICALLY REGULATING TENSIONS OF GUIDE ROPES OF FLEXIBLE CABLE SUSPENSION PLATFORM

RELATED APPLICATIONS

The present application is a National Phase entry of PCT Application No. PCT/CN2014/071574, filed Jan. 27, 2014, which claims priority from CN Patent Application No. 201310285331.X, filed Jul. 8, 2013, said applications being hereby incorporated by reference herein in their entirety.

FIELD OF THE INVENTION

The present invention relates to a system and a method for automatically regulating the tensions of guide ropes, in particular to a system and a method for automatically regulating the tensions of guide ropes of a flexible cable suspension platform applicable to dynamic regulation of the tensions of guide ropes in hanging scaffold systems in vertical shafts.

BACKGROUND OF THE INVENTION

At present, in most hanging scaffold systems used in construction of vertical shafts, the guide ropes hung on a hanging scaffold are used as guide tracks for lifting a bucket in the vertical shaft. The guide ropes must have certain tensions to ensure lifting the bucket smoothly. However, there are some problems related to the tensions of the guide ropes. For example, the magnitude of the tensions of the guide ropes can not be measured, and can not be regulated conveniently; in addition, the tensions of the guide ropes can not be regulated when they are different from each other.

SUMMARY OF THE INVENTION

In view of the problems in the prior art, the present invention provides a system and a method for automatically regulating the tensions of guide ropes of a flexible cable suspension platform, which are easy to use, can measure the tensions of the guide ropes, and can regulate the tension conveniently.

In one embodiment, the system for automatically regulating the tensions of guide ropes of a flexible cable suspension platform comprises a flexible cable suspension platform, guide ropes, a guide rope winch, suspension ropes, and a suspension rope winch, wherein, the flexible cable suspension platform is provided with a guide rope regulator connected to the lower ends of the guide ropes and a hydraulic pump station connected with the guide rope regulator.

The guide rope regulator comprises two conjugated connecting plates, a regulating plate with strip notches arranged between the two conjugated connecting plates, and hydraulic oil cylinders arranged in the strip notches, wherein, the two conjugated connecting plates are provided with a pressing plate on the upper part, a protecting plate on the middle part, and a connecting hole connected to a pin shaft of the flexible cable suspension platform on the lower part respectively, the upper part of the regulating plate is connected with a wedge-shaped rope ring designed to fix the lower end of a guide rope, a cushion block is provided on the bottom of the regulating plate, and the top part of the hydraulic oil cylinder is connected with a bearing block via a connecting hole of the oil cylinder.

The hydraulic pump station comprises a hydraulic pump, wherein, a safety valve is arranged at an oil outlet of the hydraulic pump. A two-position two-way directional control valve, a non-return valve, a single-shot booster, and a pressure sensor that are connected to the oil inlets of a plurality of hydraulic oil cylinders respectively are arranged sequentially on the discharge pipeline of the hydraulic pump. A two-position three-way directional control valve is arranged at the oil outlet of the hydraulic oil cylinder, a pilot overflow valve and connecting pipelines designed to connect all hydraulic oil cylinders are arranged at the left oil outlet of the two-position three-way directional control valve.

The guide ropes are two or four ropes, arranged in symmetry on the circumference of the flexible cable suspension platform.

An embodiment of a method for automatically regulating the tension of guide ropes of a flexible cable suspension platform, which utilizes the system described above, is as follows:

When the lifting winch winds up the lifting ropes to drive the lifting container to move along the guide ropes, the guide ropes connected with the flexible cable suspension platform begin to operate, the regulating plate moves up and down between the two connecting plates under the guiding action of the bearing block and the driving action of a piston rod in the hydraulic oil cylinder, so that the guide ropes above the regulating plate are regulated dynamically. The guide ropes apply force on the piston rod in the hydraulic oil cylinder by pulling the regulating plate. The relationship between the tension of the guide ropes and the pressure in the oil chamber of the hydraulic oil cylinder is:

$$F=P\times S$$

where, F represents the tension of the guide rope, P represents the pressure in the oil chamber of the hydraulic oil cylinder, and S represents the sectional area of the oil chamber of the hydraulic oil cylinder. The pressure in the oil chamber can be measured directly by the pressure sensor, and then the tensions of the guide ropes can be obtained with the above relational expression.

To control the tensions of all guide ropes to the same value, all the two-position three-way valves should be set to the right positions, while all the two-position two-way valves should be set to the left positions, so that all the hydraulic oil cylinders form a closed-loop inter-communicated hydraulic pressure system and the pressure values in all the hydraulic oil cylinders are equal to each other. In that way, the tensions of the guide ropes are regulated dynamically, so that they are balanced automatically.

To regulate the tension of a specific guide rope automatically, the two-position three-way directional control valve corresponding to the hydraulic oil cylinder of the guide rope regulator connected to the specific guide rope should be set to the left position, while the corresponding two-position two-way directional control valve should be set to the right position, so that the oil outlet of the hydraulic oil cylinder communicates with the pilot overflow valve, and the tension of the specific guide rope can be fixed to a set value by regulating the pilot overflow valve according to the reading on the pressure sensor connected with the hydraulic oil cylinder. Under the action of the pilot overflow valve, the tension of the guide rope will be regulated by the guide rope regulator, so that the tension of the guide rope is always kept within the range of the set value.

With the technical solution described above, the tension of a guide rope can be regulated conveniently by regulating a pilot overflow valve. In addition, the tension of the guide rope can be measured conveniently and accurately by a pressure sensor, and thereby the tension state of the guide rope can be detected conveniently, to ensure the guide ropes have enough tension to effectively limit the swing amplitude during operation of the lifting container. The system is simple and convenient to operate, has a good automatic regulating effect, and thus has wide applicability.

DETAILED DESCRIPTION OF THE DRAWINGS

Figure 1:
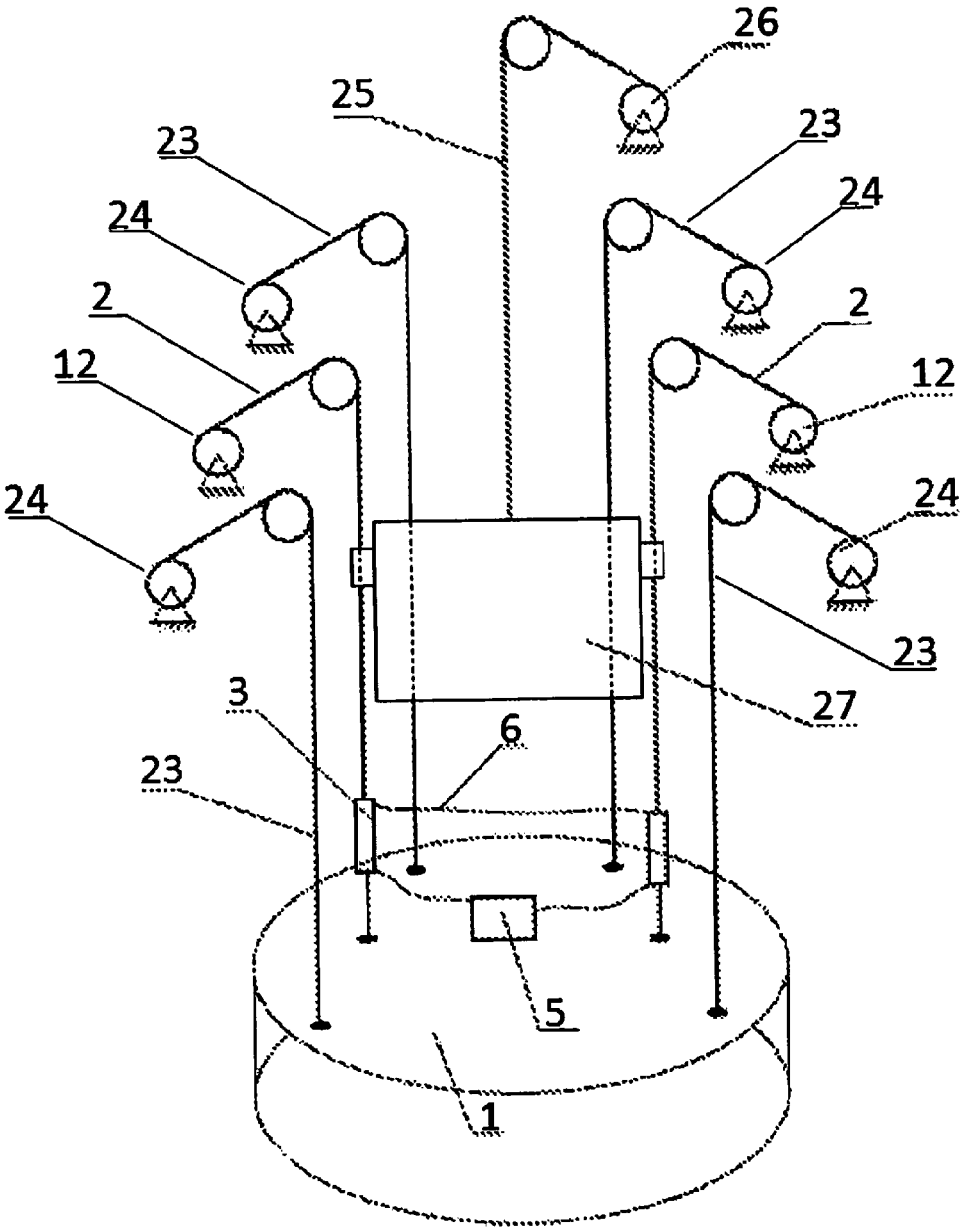
FIG. 1 is a schematic structural diagram of the system according to an embodiment of the present invention.
Figure 2:
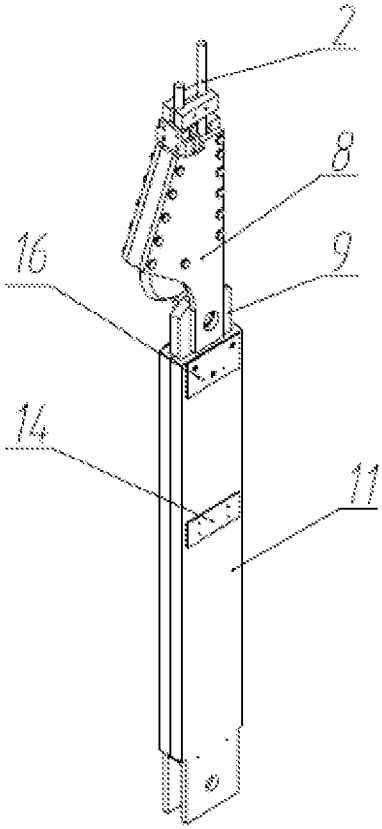
FIG. 2 is a 3D structural diagram of the guide rope regulator according to an embodiment of the present invention.
Figure 3:
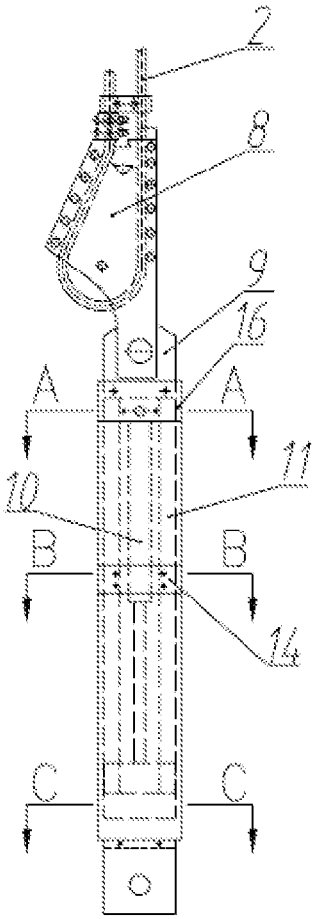
FIG. 3 is a plan structural diagram of the guide rope regulator according to an embodiment of the present invention.
Figure 4:
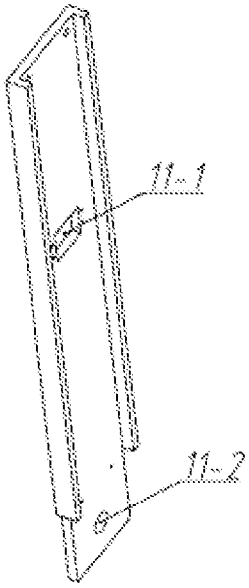
FIG. 4 is a schematic structural diagram of the connecting plate depicted in FIG. 3.
Figure 5:
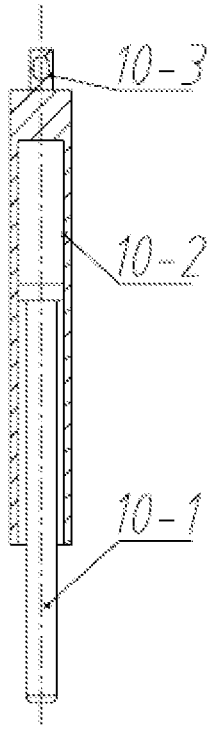
FIG. 5 is a schematic structural diagram of the hydraulic oil cylinder depicted in FIG. 3.
Figure 6:
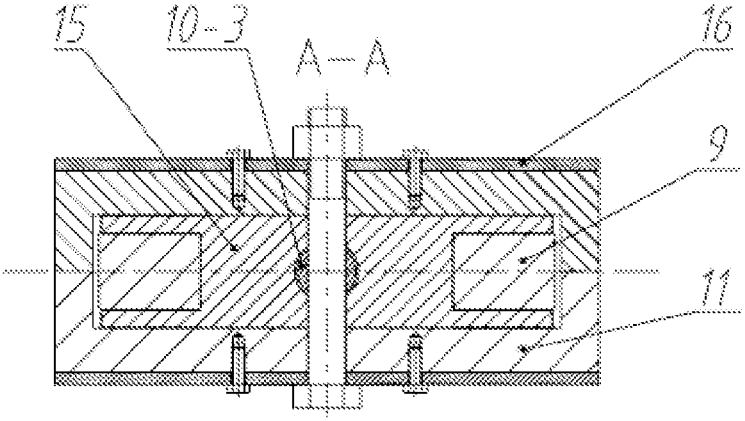
FIG. 6 is a sectional view A-A of the structure depicted in FIG. 3.
Figure 7:
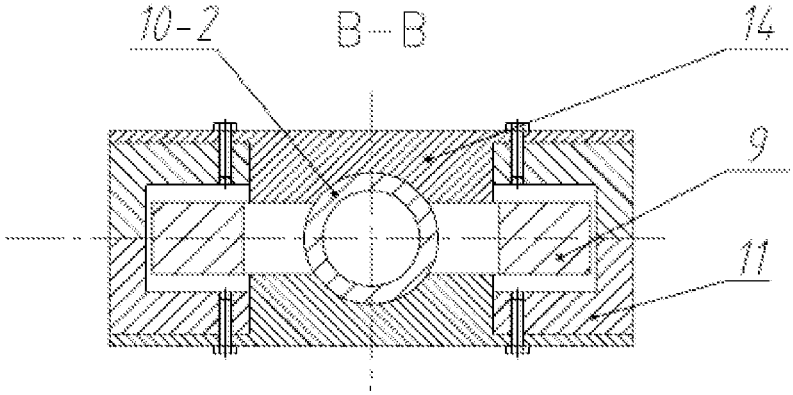
FIG. 7 is a sectional view B-B of the structure depicted in FIG. 3.
Figure 8:
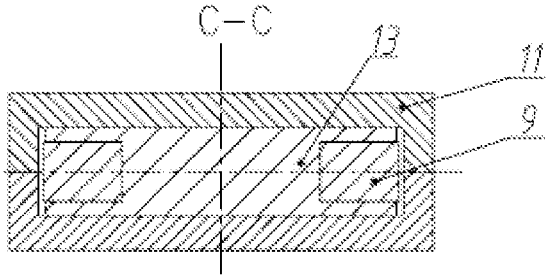
FIG. 8 is a sectional view C-C of the structure depicted in FIG. 3.

Hereunder the present invention will be further detailed in an embodiment, with reference to the accompanying drawings.

The system for automatically regulating the tensions of guide ropes of a flexible cable suspension platform according to an embodiment of the present invention includes a flexible cable suspension platform 1 suspended by suspension ropes 23 wound up by suspension rope winch 24, and a plurality of guide ropes 2 with one end fixed to the flexible cable suspension platform 1 and the other end fixed to the guide rope winch 12. The guide ropes 2 are two or four ropes, and the suspension ropes 23 are four ropes, which are evenly distributed on the circumference of the flexible cable suspension platform 1. The flexible cable suspension platform 1 is provided with a guide rope regulator 3 connected to the lower ends of the guide ropes 2 and a hydraulic pump station 5 connected with the guide rope regulator 3.

The guide rope regulator 3 includes two conjugated connecting plates 11, a regulating plate 9 with strip notches arranged between the two conjugated connecting plates 11, and hydraulic oil cylinders 10 arranged in the strip notches of the regulating plate 9. The two conjugated connecting plates 11 are provided with a pressing plate 16 on the upper part, a protecting plate 14 on the middle part, and a connecting hole 11-2 connected to a pin shaft of the flexible cable suspension platform 1 on the lower part respectively. The upper part of the regulating plate 9 is connected with a wedge-shaped rope ring 8 designed to fix the lower end of a guide rope 2. A cushion block 13 is provided on the bottom of the regulating plate 9, and the top part of the hydraulic oil cylinder 10 is connected with a bearing block 15 via a connecting hole 10-3 of the oil cylinder.

The hydraulic pump station 5 includes a hydraulic pump 18. A safety valve 17 is arranged at an oil outlet of the hydraulic pump 18, a two-position two-way directional control valve 22, a non-return valve 19, a single-shot pressure booster 7, and a pressure sensor 4 are connected to the oil inlets of a plurality of hydraulic oil cylinders 10 respectively, and are arranged sequentially on the discharge pipeline of the hydraulic pump. A two-position three-way directional control valve 20 is arranged at the oil outlet of the hydraulic oil cylinder 10. A pilot overflow valve 21 and connecting pipelines 6 designed to connect all the hydraulic oil cylinders 10 are arranged at the left oil outlet of the two-position three-way directional control valve 20.

A method for automatically regulating the tensions of guide ropes of a flexible cable suspension platform provided in an embodiment of the present invention is as follows:

When the lifting winch 26 winds up the lifting ropes 25 and drives the lifting container 27 to move along the guide ropes 2, the guide ropes 2 connected with the flexible cable suspension platform 1 begin to operate. The regulating plate 9 moves up and down between the two connecting plates 11 under the guiding action of the bearing block 15 and the driving action of the piston rod of the hydraulic oil cylinder 10, so that the guide ropes 2 above the regulating plate 9 are regulated dynamically. The guide ropes 2 apply force on the piston rod of the hydraulic oil cylinder 10 by pulling the regulating plate 9. The relationship between the tensions of the guide ropes 2 and the pressure in the oil chamber of the hydraulic oil cylinder 10 is as follows:

$$F=P\times S$$

where, F represents the tension of the guide rope 2, P represents the pressure in the oil chamber of the hydraulic oil cylinder 10, and S represents the sectional area of the oil chamber of the hydraulic oil cylinder 10. The pressure in the oil chamber can be measured directly by the pressure sensor 4, and then the tension of the guide rope 2 can be obtained with the above relational expression.

To control the tensions of all the guide ropes 2 to the same value, all the two-position three-way valves 20 should be set to the right positions, while all the two-position two-way valves 22 should be set to the left positions, so that all hydraulic oil cylinders 10 form a closed-loop inter-communicated hydraulic pressure system and the pressure values in all the hydraulic oil cylinders 10 are equal to each other. In that way, the tensions of the guide ropes 2 are regulated dynamically, so that they are balanced automatically.

To regulate the tension of a specific guide rope 2 automatically, the two-position three-way directional control valve 20 corresponding to the hydraulic oil cylinder 10 of the guide rope regulator 3 connected to the guide rope 2 should be set to the left position, while the corresponding two-position two-way directional control valve 22 should be set to the right position, so that the oil outlet of the hydraulic oil cylinder 10 communicates with the pilot overflow valve 21, and the tension of the guide rope 2 can be fixed to a set value by regulating the pilot overflow valve 21 according to the reading on the pressure sensor 4 connected with the hydraulic oil cylinder 10. Under the action of the pilot overflow valve 21, the tension of the guide rope 2 will be regulated by the guide rope regulator 3 automatically, so that the tension of the guide rope 2 is always kept within the range of the set value.

As shown in FIG. 1, the flexible cable suspension platform 1 is suspended by four suspension ropes 23 and two guide ropes 2, and the flexible cable suspension platform 1 is lifted by the suspension ropes 23 wound up by the suspension rope winch 24. The lifting container 27 is lifted by the lifting ropes 25 wound by the lifting winch 26 along the guide ropes 2. The lower parts of the guide ropes 2 are connected with the guide rope regulator 3 via the wedge-shaped rope ring 8. The hydraulic oil cylinders 10 of the guide rope regulator 3 below the two guide ropes 2 are connected with each other through the connecting pipelines 6. The winding/releasing of the guide ropes 2 is accomplished by means of the guide rope winch 12 on the ground. The hydraulic pump station 5 arranged on the flexible cable suspension platform supplies oil to all the hydraulic oil cylinders 10 on the guide rope regulator 3. The oil outlets of the hydraulic oil cylinders 10 communicate with each other through the connecting pipelines 6. Each hydraulic oil cylinder 10 is connected with a pressure sensor 4, and the tensions of the guide ropes can be measured conveniently according to the reading on the pressure sensor 4.

In FIGS. 2-8, the wedge-shaped rope ring 8 is depicted as hinged to the regulating plate 9 via a pin shaft, the hydraulic oil cylinder 10 is arranged in a notch of the regulating plate 9, the upper part of the cylinder body 10-2 of the hydraulic oil cylinder 10 is connected with the bearing block 15 by bolts via the connecting holes 10-3 on the oil cylinder, and the bolts that connect the hydraulic oil cylinder 10 with the bearing block 15 also ensure tight conjugation between the two connecting plates. The piston rod 10-1 in the hydraulic oil cylinder 10 contacts with the cushion blocks 13 arranged on the bottom of the regulating plate 9. The bearing blocks 15 and the pressing plates 16 are fixedly connected with the connecting plates 11 by bolts respectively. The protecting plates 14 are embedded in the notches 11-1 of the connecting plates and are fixed to the connecting plates 11 respectively, and the two protecting plates 14 are designed to fasten the cylinder body 10-2 of the oil cylinder. The two conjugated connecting plates 11 are connected to the flexible cable suspension platform 1 by a pin shaft via the connecting hole 11-2.

Figure 9:
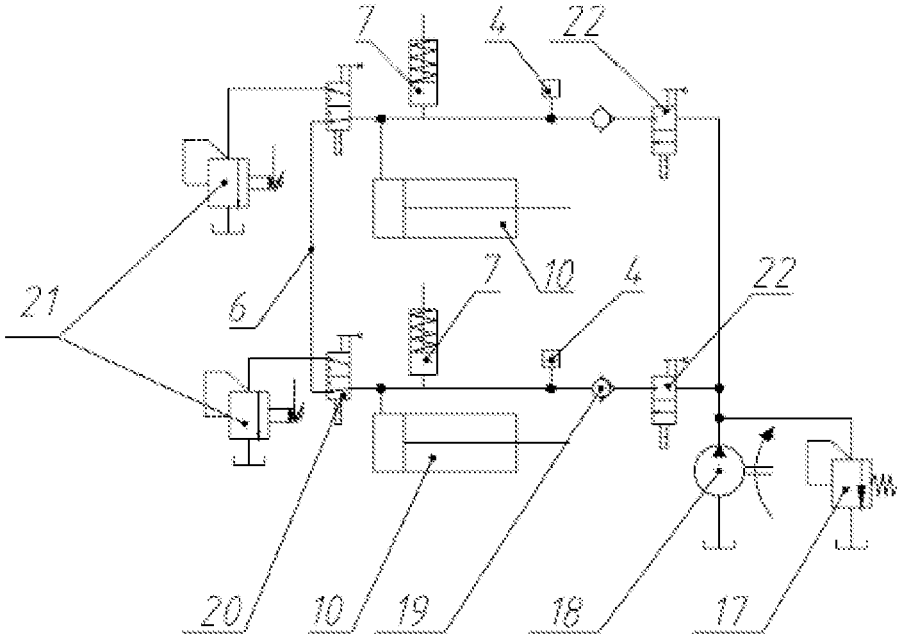
FIG. 9 is a schematic diagram of the hydraulic system according to an embodiment of the present invention.

As shown in FIG. 9, a two-position two-way directional control valve 22, a non-return valve 19, and a pressure sensor 4 are arranged sequentially between the oil outlet of the hydraulic pump 18 and the oil inlet of a hydraulic oil cylinder 10 respectively. To regulate the tensions of all the guide ropes 2 to the same value, all the two-position two-way directional control valves 22 should be set to the left position, while all the two-position three-way directional control valves 20 should be set to the right position, so that the oil chambers of all the hydraulic oil cylinders 10 communicate with each other and the pressure values in all the oil chambers are the same. Then, the system can regulate the tensions of the guide ropes 2 automatically to the same value. To regulate the tension of a specific guide rope 2, the two-position two-way directional control valve 22 corresponding to the hydraulic oil cylinder 10 of the guide rope regulator connected with that guide rope 2 should be set to the right position, while the corresponding two-position three-way directional control valve 20 should be set to the left position, so that the oil outlet of the hydraulic oil cylinder 10 is connected with the pilot overflow valve 21. Thus, the pressure in the oil chamber of the hydraulic oil cylinder 10 can be kept at a fixed value by regulating the pilot overflow valve 21 according to the reading on the pressure sensor 4 connected with the hydraulic oil cylinder 10, and thereby the guide rope regulator 3 can regulate the tension of the guide rope, to keep the tension of the guide rope 2 at a fixed value.

The invention claimed is:

1. A guide rope tensioning system for a flexible cable suspension platform system, the flexible cable suspension platform system having a platform operably coupled to a plurality of guide ropes, each of the plurality of guide ropes operably coupled to a corresponding guide rope winch at one end, the guide rope tensioning system configured to automatically regulate and balance tension among the plurality of guide ropes, the guide rope tensioning system comprising:

a plurality of guide rope regulators, each of the plurality of guide rope regulators operably coupled to a corresponding one of the plurality of guide ropes at an end of the guide rope opposite to the corresponding guide rope winch, each of the plurality of guide rope regulators including two conjugated connecting plates including a bottom portion defining a connecting hole for operable engagement with the platform, a regulating plate defining a strip notch arranged between the two conjugated connecting plates, the regulating plate operably coupled to a rope ring for operable engagement with the corresponding guide rope, and a hydraulic oil cylinder arranged in the strip notch of the regulating plate, the hydraulic oil cylinder having an oil chamber operably coupled to the regulating plate and a connecting rod operably coupled to the two conjugated connecting plates, in order to enable the regulating plate to shift relative to the two connecting plates; and a hydraulic pump station operably coupled to the plurality of guide rope regulators, the hydraulic pump station configured to measure, equalize and regulate fluid pressure among the hydraulic oil cylinders of each of the plurality of guide rope regulators, the hydraulic pump station including a hydraulic pump, a safety valve operably coupled to the hydraulic pump, a two-position two-way directional control valve, a non-return valve, a single-shot pressure booster, a pressure sensor operably coupled to an oil inlet of each hydraulic oil cylinder, a two-position three-way directional control valve operably coupled to an oil outlet of each hydraulic oil cylinder, and a pilot overflow valve and a pipeline operably coupling the hydraulic oil cylinders to the two-position three-way directional control valve.

2. The guide rope tensioning system of claim 1, wherein, the plurality of guide ropes include two guide ropes arranged in symmetry on a circumference of the platform of the flexible cable suspension platform system.

3. The guide rope tensioning system of claim 1, wherein, the plurality of guide ropes include four guide ropes arranged in symmetry on a circumference of the platform of the flexible cable suspension platform system.

4. The guide rope tensioning system of claim 1, said two position three-way directional control valve including a left oil outlet, said hydraulic oil cylinders being operably coupled to said left oil outlet.

* * * * *